United States Patent [19]

Sudo et al.

[11] Patent Number: 4,753,082

[45] Date of Patent: Jun. 28, 1988

[54] METHOD FOR MANUFACTURING ICE AND APPARATUS THEREFOR

[75] Inventors: Masanobu Sudo; Masanori Inoue; Takao Ebinuma, all of Tokyo, Japan

[73] Assignee: Nippon Kokan Kabushiki Kaisha, Tokyo, Japan

[21] Appl. No.: 84,470

[22] Filed: Aug. 10, 1987

[30] Foreign Application Priority Data

Feb. 2, 1987 [JP] Japan ..... 62-20489

[51] Int. Cl.[4] ..... F25C 1/18

[52] U.S. Cl. ..... 62/69; 62/35; 62/341

[58] Field of Search ..... 62/9, 10, 11, 12, 13, 62/35, 66, 75, 76, 330, 341, 69

[56] References Cited

U.S. PATENT DOCUMENTS

| | | | |
|---|---|---|---|
| 530,526 | 12/1894 | Holden | 62/341 |
| 828,887 | 8/1906 | Hoofnagle | 62/75 |
| 1,982,842 | 12/1934 | Taylor | 62/341 |
| 2,082,665 | 6/1937 | Uline | 62/75 |
| 2,145,096 | 1/1939 | Schutz | 62/35 |
| 2,253,880 | 8/1941 | Zieber | 62/35 |
| 4,374,658 | 2/1983 | Kawaguchi | 62/35 |
| 4,398,395 | 8/1983 | Hinmari et al. | 62/69 X |
| 4,404,807 | 9/1983 | Zamelman et al. | 62/69 X |
| 4,412,852 | 11/1983 | Umino et al. | 62/35 |

FOREIGN PATENT DOCUMENTS 54-3948 12/1979 Japan .

*Primary Examiner*—Steven E. Warner

*Attorney, Agent, or Firm*—Frishauf, Holtz, Goodman & Woodward

[57] ABSTRACT

A method for manufacturing ice comprising the steps of: supplying gas into a pressure-resistant vessel containing ice grains, the pressure of the supplied gas being kept increased; applying a press force to the ice grains to increase the density of the ice grains, contact portions of the ice grains being allowed to be melted; and cooling the ice grains, in the pressed state, to freeze the ice grains. Gas to be introduced into the vessel is at least one selected from those of air, oxygen and carbon dioxide. An apparatus used for the method is also provided.

15 Claims, 1 Drawing Sheet

METHOD FOR MANUFACTURING ICE AND APPARATUS THEREFOR

BACKGRUND OF THE INVENTION

1. Field of the Invention

The present invention relates to a method for manufacturing ice and an apparatus therefor, and more particularly to a method and an apparatus for manufacturing ice suitable for drinks which pleases users.

2. Description of the Prior Art

Ice for drinks is used to make it easy to drink by means of cooling the drinks. In particular, transparent ice is preferred because of its image of crystal. Such transparent ice is provided not only with a crystal image but also with elegance and charm when enjoyed, if other features are added to such transparent ice. Hitherto, no special ice, except for having a feature of transparency, has been developed.

SUMMARY OF THE INVENTION

It is an object of the present invention to provide a method and an apparatus for manufacturing ice which will produce a pleasent sound when it is used.

In accordance with the present invention a method is provided for manufacturing ice, which comprises the steps of:

supplying ice grains into a pressure-resistant vessel;

pressing the ice grains together to increase the density of the ice grains, whereby contact portions of the ice grains are melted; and cooling the ice grains, in said pressed state to allow the ice grains to be frozen.

Furthermore, an apparatus is provided, which comprises:

a pressure-resistant vessel for receiving ice grains therein;

a supply means for introducing gas into the pressure-resistant vessel;

a press means for pressing the ice grains in the pressure-resistant vessel; and a cooling means for cooling the ice grains in the pressure-resistant vessel.

Other objects and advantages of the present invention will become apparent from the detailed description to follow, taken in conjunction with the appended drawing.

DESCRIPTION OF THE PREFERRED EMBODIMENT

Figure 1:
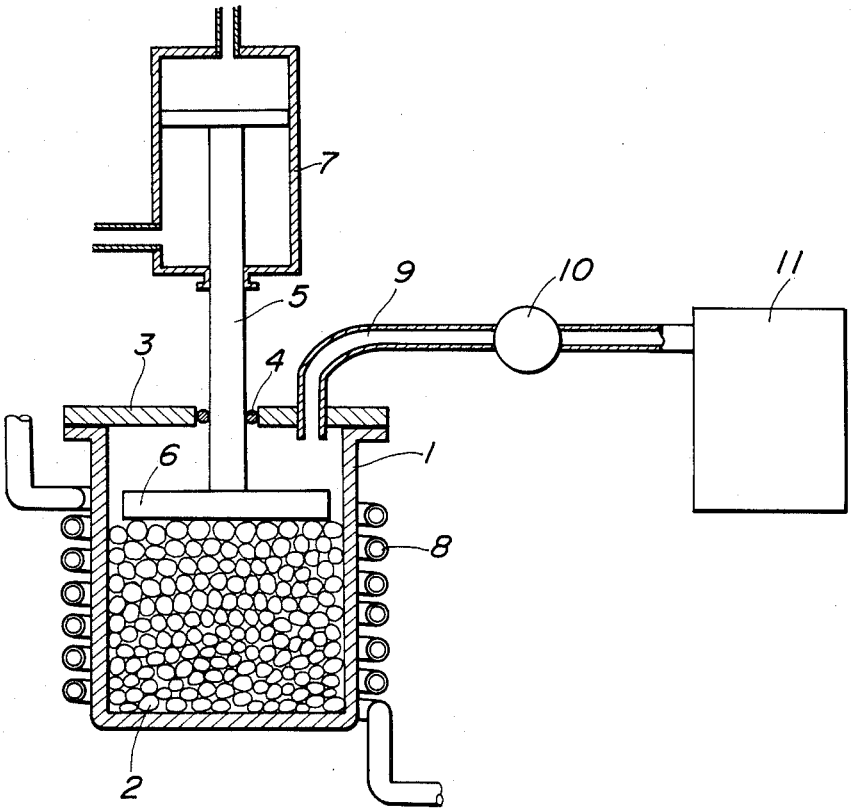
FIG. 1 is a sectional view showing an embodiment of an apparatus according to the present invention.

Now, an embodiment of an apparatus for manufacturing ice according to the present invention will be described with specific reference to FIG. 1 of the drawing.

In FIG. 1, referential numeral 1 denotes a pressure-resistant vessel, into which ice grains 2 are supplied. Cover 3 is set at the upper part of the pressure-resistant vessel and at the center of the cover there is an opening through which rod 5 is inserted. O-ring 4 is set in the periphery of the opening to keep the inside of pressure-resistant vessel 1 sealed. Gas supply pipe 9 is fitted to cover 3 and connected through pressure control valve 10 to gas supply source 11 so that gas may be introduced through the gas supply pipe from the gas supply source into the pressure-resistant vessel. Thus, the pressure inside the pressure-resistant vessel is continuously being increased. The gas pressure is optionally controlled by pressure control valve 10. Press plate 6 fitted to the end of rod 5 press ice grains 2. Rod 5 is moved vertically up and down in contact with O-ring 4 by hydraulic device 7. The pressing force of press plate 6 is also varied optionally by the hydraulic device. Around pressure-resistant vessel 1, tube 8 is coiled up to pass brine through the tube, thereby ice grains 2 being cooled.

Secondly, an embodiment of a method for manufacturing ice will now be described with particular reference to FIG. 1 of the drawing.

Step 1: Ice grains 2 are prepared.

Step 2: Pressure-resistant vessel 1 is filled with ice grains 2 and closed by setting cover 3 thereon. The pressure-resistant vessel is kept tightly sealed by Q-ring 4 fitted in the periphery of an opening at the center of the cover.

Step 3: Gas, selected from those of air, oxygen and carbon dioxide, is introduced, through pressure control valve 10, from gas supply source 11 into pressure-resistant vessel 1 and is kept sealed. The pressure inside the pressure-resistant vessel is being increased.

Step 4: Press plate 6 is moved down through rod 5 by means of hydraulic device 7. The press plate goes down to press ice grains 2 and increases the density of many of the ice grains. Resultantly, each of the contact portions of the ice grains begins to melt. When the ice grains, each, melt by pressing, gas existing in voids among the ice grains increases its own pressure. By means of melting of the contact portions of the ice grains, the gas exsisting in voids is completely separated to become spherical bubbles, which are shut in (i.e., trapped) among the ice grains.

Step 5: In the state that the press force added in Step 4 is being kept, the temperature of the ice grains in Step (4) is lowered by cooling means. The ice grains, each thus cooled, will form an integrated lump of ice through freezing of the melted portions of the ice grains. The integrated lump of ice contains the gas bubbles of high pressure having existed among the ice grains.

Step 6: Finally, the press force through press plate 6 is taken away and cover 3 is taken off. The ice, thus manufactured as a product, can be taken out of pressure-resistant vessel 1.

Along with the above steps, gas bubbles whose pressure has been increased are included homogeneously and dispersively in an integrated lump of ice manufactured by freezing. When the ice is used for drinks, the ice cracks and bursts open one after another near the surface of the ice with pleasant sounds as if something splitted open lightly. Thus, these sounds give elegance and charm to drinkers.

With reference to each of the Steps, specific explanations will now be given.

The size of ice grains 2 prepared at Step 1 ranges preferably 0.05 to 10 mm in diameter. 0.5 to 5 mm is more preferable. If the size is less than 0.05 mm, manufactured ice becomes cloudy and impairs its beauty. In addition, gas bubbles included in the manfactured ice are so small in size that sounds of bursting of the manufactured ice become small when the manufactured ice is used for drinks. On the other hand, if the size of the ice grains is over 10 mm, the occurring frequency of the sounds are remarkably decreased.

The more spherical and transparent the ice grains are, the more desirable. When the form of the ice grains is close to sphere, gas bubbles get spherical in the state that quantity of water produced by pressing in step 2 is small. In addition, the size and distribution of the gas bubbles become more uniform and homogeneous. Those ice grains can be prepared either by freezing drops of water or by breaking lump of ice.

The preferable gas pressure of the inside of pressure-resistant vessel 1, into which the ice grains are supplied, is of 1 to 40 atm. If the pressure is less than 1 atm., the size of gas bubbles included in the manufactured ice is small or there are almost no gas bubbles included in the manufactured ice. If the pressure is over 40 atm., the gas bubbles become so large that the manufactured ice is broken when given press force is taken away. 3 to 40 atm. is more preferable.

The temperature at the time when press force is applied to ice grains 2 in Step 4 ranges preferably −0.1° to −2° C. If the temperature is lower than −2° C., the press force for increasing density of the ice grains are additionally required as much as the lowered temperature. This is not economical. In addition, the increase of the press force causes the ice grains to be broken. If the temperature becomes higher than −0.1° C., the ice grains melt. The press force to be applied to the ice grains depends almost on temperature condition. The higher the temperature of the ice grains becomes, the less the press force is required. The relationship between the temperature and the stress conforms nearly to formula of Clapeyron-Clausis. The preferable press force is 15 to 280 kg/cm$^2$.

The temperature for cooling ice grains 2 at Step 5 preferably ranges −2° C. to −20° C. If the ice grains are cooled at the temperature higher than −2° C., the cooling speed is too much slow. Owing to this, much more time for cooling is required, which is not economical. If the temperature is lower than −20° C., the cooling speed is to much fast. This produces much stress to cause cracking of the ice grains.

In addition, in the case that the press force is given by a single shaft press, owing to the manufactured ice being frozen fittedly to the inwall of the vessel, the press force is hard to be taken away. The temperature for cooling ranges most preferably −2° C. to −10° C.

It is not desirable to rapidly take away the press force to the ice grains, since such rapid removal causes cracking of the ice grains. The preferable range of the removal speed is $10^{-7}$ to $10^{-3}$ l/sec. by strain rate. If the strain rate is less than $10^{-7}$, it takes too much time to remove the press force. If it is over $10^{-3}$, ice to be manufactured becomes brittle enough to cause cracking of the ice. It is recommendable that control of taking away the press force is carried out by changing the press force by stages through measuring displacement of ice volume. This removal control can be attained either by press control or by displacement control.

In the foregoing embodiment, air, oxygen and carbondioxide are used as gas for maintaining the inside pressure of pressure-resistant vessel 1 at Step 3. In stead of those gases, aromatic gass can be used. In this case, an aromatic gas is introduced into the pressure-resistant vessel after the inside of the vessel has become vacuum by exhausting inside air therefrom. Except for Step 3, the same steps as Step 1 through 6 mentioned are carried out. Ice manufactured contains gas bubbles which are aromatic. When the ice cracks open, fragrance out of the gas bubbles fills pleasantly with a glass. Consequently, elegance and charm of ice are promoted.

The present invention effects giving elegance and charm to drinkers. Since frozen ice contains gas bubbles of high pressure homogeneously and dispersively, the frozen ice cracks and bursts open one after another at the crack or near the surface of the frozen ice with pleasant sounds as if something splitted open lightly, when the ice is used for drinks. If, at initial stage when ice grains are supplied into the pressure-resistant vessel, initial pressure of gas in the pressure-resistant vessel is more than 1 atm, the gas bubbles are allowed to exist in voids among the ice grains so much that the elegance and charm of the frozen ice is furthered. Furthermore, if aromatic gas is supplied to the pressure-resistant vessel, the elegance and charm of the frozen ice is much more promoted, since fragrance of the gas bubbles floats inside a glass when the frozen ice cracks.

EXAMPLE

Ice was manufactured by using an apparatus illustrated in FIG. 1.

Firstly, ice grains of 2 to 4 mm in diameter were supplied to pressure-resistant vessel 1. Air was introduced through gas supply pipe 9 to vessel 1 and then initial air pressure was set to 5 atm. Subsequently, press force was applied to the ice grains at a rate of 1 kg/cm$^2$ per second and at a temperature of −0.3° C. The ice grains began melting at press force of approximately 40 kg/cm$^2$. Pressing was performed at press force of 70 kg/cm$^2$ for 15 minutes, since gas bubbles are hard to become spherical if melting amount is small. Most of gas bubbles became spherical and transparent. Next, temperature of the ice grains was set to −3° C. to cool the ice grains. When ice is frozen, the press force applied was taken away at a rate of strain of $10^{-5}$ l/sec.

The manufactured ice included spherical gas bubbles uniformly and dispersively. The ice cracked open with pleasant sounds when put in whisky or juice.

What is claimed is:

1. A method for manufacturing ice having gas bubbles therein, comprising:

introducing a gas into a pressure-resistant vessel containing ice grains of from 0.05 to 10 mm in diameter, and maintaining a pressure of said gas inside the pressure-resistant vessel at from 1 to 40 atm.;

mechanically pressing the ice grains together in said pressure-resistant vessel while said gas pressure inside said pressure-resistant vessel is maintained at from 1 to 40 atm., to increase the density of the ice grains and to cause contact portions of contacting ice grains to be melted;

freezing the ice grains thus increased in density in a state when the ice grains are kept mechanically pressed together at a pressure of from 15 to 280 kg/cm$^2$, so that gas is contained in the ice formed in the freezing step; and releasing the mechanical pressure applied to the ice grains after freezing of the increased density ice grains is completed.

2. The method of claim 1, wherein said gas includes an aromatic gas.

3. The method of claim 1, wherin the pressure of said gas in said pressure-resistant vessel is from 3 to 40 atm.

4. The method of claim 1, wherein said gas includes at least one selected from the group consisting of air, oxygen and carbon dioxide.

5. The method of claim 1, wherein said step of releasing said mechanical press force is carried out at a strain rate of $10^{-7}$ to $10^{-3}$ l/sec.

6. The method of claim 1, wherein the diameter of said ice grains is from 0.5 to 5 mm.

7. The method of claim 1, comprising forming said ice grains by freezing drops of water.

8. The method of claim 1, comprising forming said ice grains by breaking lumps of ice.

9. The method of claim 1, wherein said step of mechanically pressing the ice grains is carried out at a temperature of from −0.1° to −2° C.

10. The method of claim 9, wherein said gas includes at least one selected form the group consisting of air, oxygen and carbon dioxide.

11. Apparatus for manufacturing ice having gas bubbles therein, comprising:

a pressure-resistant vessel for receiving a supply of ice grains therein;

means for introducing a gas into said pressure-resistant vessel so as to increase the gas pressure in said pressure-resistant vessel to a pressure of from 1 to 40 atm. after a plurality of ice grains of from 0.05 to 10 mm in diameter is supplied into said pressure-resistant vessel;

mechanical pressing means at least partially within said pressure-resistant vessel for applying a mechanical pressing force of from 15 to 280 kg/cm$^2$ to said ice grains in said pressure-resistant vessel while said gas is supplied to said pressure-resistant vessel to maintain the gas pressure in said pressure-resistant vessel at from 1 to 40 atm., for thereby increasing the density of the ice grains and to cause contact portions of contacting ice grains to be melted; and cooling means for cooling the ice grains in said pressure-resistant vessel to freeze said ice grains with gas contained therein; and means for releasing said mechanical pressure applied to said ice grains after freezing of said ice grains is completed.

12. The apparatus of claim 11, wherein said means for introducing said gas into said pressure-resistant vessel comprises a conduit passing through a cover of said pressure-resistant vessel.

13. The apparatus of claim 11, wherein said mechanical pressing means comprises a press plate mounted within said pressure-resistant vessel for mechanically bearing on said plurality on said ice grains in said pressure-resistant vessel; and means coupled to said press plate and passing through a cover of said pressure-resistant vessel for applying a pressing force to said press plate.

14. The apparatus of claim 13, wherein said means coupled to said press plate comprises a piston rod.

15. The apparatus of claim 13, wherein said means for introducing a gas into said pressure-resistant vessel comprises a conduit passing through said cover of said pressure-resistant vessel.

* * * * *

UNITED STATES PATENT AND TRADEMARK OFFICE

CERTIFICATE OF CORRECTION

PATENT NO. : 4,753,082

DATED : June 28, 1988

INVENTOR(S) : SUDO et al

It is certified that error appears in the above-identified patent and that said Letters Patent is hereby corrected as shown below:

Column 1, line 32, following "state" insert -- , --

Column 2, line 17, "Q-ring", should read -- O-ring -- line 34, "exsisting" should read -- existing --

Column 4, line 64, "wherin" should read -- wherein --

Signed and Sealed this

Seventeenth Day of January, 1989

*Attest:*

DONALD J. QUIGG

*Attesting Officer*

*Commissioner of Patents and Trademarks*